United States Patent [19]

Karn

[11] Patent Number: 4,524,686

[45] Date of Patent: Jun. 25, 1985

[54] PRINT HEAD AND METHOD OF MAKING SAME

[75] Inventor: Donald L. Karn, Springboro, Ohio

[73] Assignee: Monarch Marking Systems, Inc., Dayton, Ohio

[21] Appl. No.: 527,727

[22] Filed: Aug. 30, 1983

[51] Int. Cl.[3] ..... B41J 1/60

[52] U.S. Cl. ..... 101/111; 101/105

[58] Field of Search ..... 101/105, 110, 111, 99; 29/426.6, 522 R; 403/71, 289, 405; 24/297, 453, 458, 573, 614, 615; 411/508–510; 46/25, 26, 28, 29

[56] References Cited

U.S. PATENT DOCUMENTS

| | | | |
|---|---|---|---|
| 3,733,655 | 5/1973 | Kolibar | 24/573 X |
| 3,948,172 | 4/1976 | Jenkins | 101/316 |
| 4,054,393 | 10/1977 | Talleri | 46/29 |
| 4,163,422 | 8/1979 | Hamisch, Jr. | 101/105 X |
| 4,271,759 | 6/1981 | Volk | 101/111 X |
| 4,283,832 | 8/1981 | Hamisch, Jr. | 29/434 |

FOREIGN PATENT DOCUMENTS

| | | | |
|---|---|---|---|
| 2809811 | 9/1978 | Fed. Rep. of Germany | 446/124 |
| 537162 | 6/1941 | United Kingdom | 411/508 |

*Primary Examiner*—Edgar S. Burr
*Assistant Examiner*—John A. Weresh
*Attorney, Agent, or Firm*—Joseph J. Grass

[57] ABSTRACT

There is disclosed a print head and method of making same, in which the print head has spaced first and second side plates connected by guide members. The side plates support mounting blocks which mount drive wheels for printing bands. The mounting blocks are strongly connected to the first side plate but are weakly connected to the second side plate and the guide members are strongly connected to the second side plate and weakly connected to the second side plate for ease of assembly and disassembly. Selectors pass through openings in the second side plate. An indicator coupled to each selector is guided by a pair of the guide members. The selector is selectively engageable with any drive wheel.

10 Claims, 3 Drawing Figures

PRINT HEAD AND METHOD OF MAKING SAME

BACKGROUND OF THE INVENTION

1. Field of the Invention

This invention relates to the art of print heads and to the method of making print heads.

2. Brief Description of the Prior Art

The following U.S. patents are made of record: U.S. Pat. No. 3,948,172 granted Apr. 6, 1976 to William A. Jenkins and 4,283,832 granted Aug. 18, 1981 to Paul H. Hamisch, Jr.

SUMMARY OF THE INVENTION

The invention is directed to print heads and to method of making print heads. In the manufacture of print heads of the printing band type it is not only desirable to have relatively few parts which can be readily made of molded plastics material, but it is also desirable to make the print head in such a way that those parts can be readily assembled, and readily disassembled if disassembly is necessary.

In accordance with the invention, a pair of first and second side plates is provided. There is also provided one or more mounting blocks, a series of drive wheels for each mounting block, a series of printing bands for each series of drive wheels, a selector for each series of drive wheels, each selector being selectively engageable with any drive wheel to advance a selected printing band, an indicator member for each selector for indicating the selected printing band with which the selector is engaged, guide members for guiding the indicator members, and guide members for guiding an ink roller. The first side plate and the mounting blocks have cooperating pairs of snap-fit connector portions which strongly hold the first side plate and the mounting blocks together. The first side plate and the one ends of the guide members are provided with cooperating locator portions for locating the guide members with respect to the first side plate. Each pair of locator portions of the guide members at the first side plate serves to locate, but also serves to weakly hold the parts together and are preferably snap-fit connectors. The second side plate and the guide members having cooperating pairs of snap-fit connectors which strongly hold the second side plate and the guide members together. The second side plate and the other ends of the mounting blocks are provided with cooperating locator portions for locating the mounting blocks with respect to the second side plate. Each pair of locator portions for the mounting blocks at the second side plate serves to locate, but also serves to weakly hold the parts together and are preferably snap-fit connectors. If desired, all of the above-mentioned locator portions can be either pins or holes which cooperate with respective holes or pins. The second side plate is provided with openings for receiving the selectors. The guide members for each indicator member mount the indicator member for shiftable movement as a unit with the selector. In assembling the print head, the mounting blocks are snapped onto the first side plate, the wheels and bands are mounted on the mounting block, the guide members are snapped onto the second side plate, the selector and indicator members are mounted on the second side plate with the indicator members being slidably mounted by the respective guide members, and the second side plate is snapped onto the mounting blocks and the guide members are snapped onto the first side plate. It is apparent that the printing bands can be loaded onto the mounting blocks without interference from the guide members. It is also apparent that when disassembling the print head, the second side plate can be unsnapped and the mounting blocks will remain snapped to the first side plate and the guide members will remain snapped to the second side plate.

DETAILED DESCRIPTION OF THE PREFERRED EMBODIMENT

Figure 1:
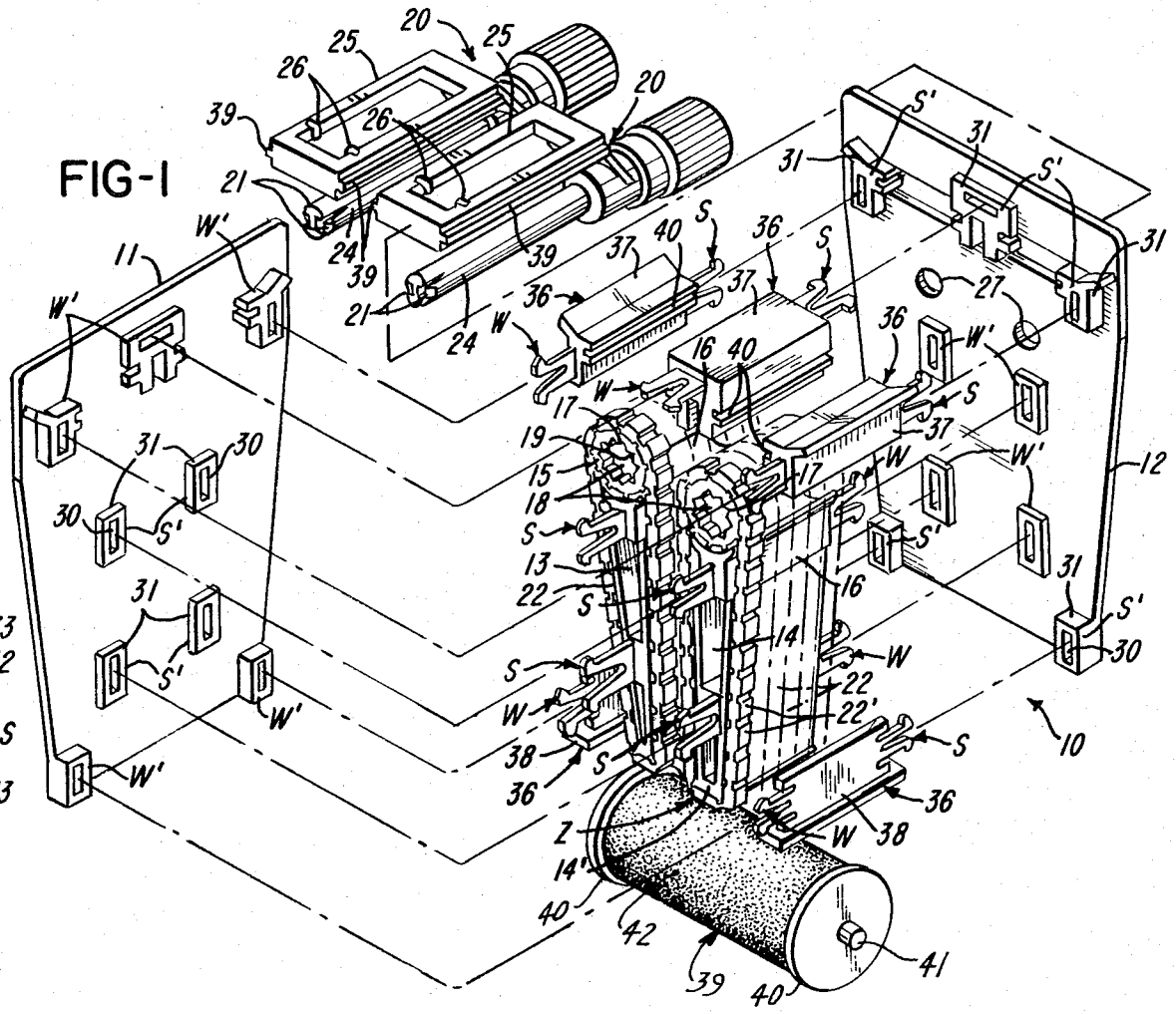
FIG. 1 is an exploded perspective view of a print head.

With reference initially to FIG. 1, there is shown a print head generally indicated at 10. The print head 10 includes a pair of spaced first and second side plates 11 and 12, a pair of mounting blocks 13 and 14, and two series of drive wheels 15 rotatably supported on respective generally arcuate concave mounting surfaces 16. For clarity only one drive wheel 15 of each series is shown in solid lines. Each wheel 15 has a central hole 17 and the holes 17 of the wheels 15 are aligned to define a continuous axial opening 18. The wheels 15 have internal notches 19. Selectors 20 have drive members 21 which engage in notches 19 of any selected drive wheel 15 to rotate the selected drive wheel 15 and to in turn advance a selected printing band 22. Each drive wheel 15 is drivingly coupled to a printing band 22. One printing band 22 of each series is shown in solid lines, the other printing bands 22 are shown in phantom lines. The printing bands 22 pass about the drive wheels 15 and suitable support structure 14' which supports one printing element 22' at a time of each printing band at a printing zone Z. Each selector 20 also includes a knob 23 and a shaft 24 to which the knob 23 and the drive members 21 are connected. As indicator member 25 has pointers 26 for printing to the selected printing band 22 with which the drive members 21 are coupled. Each indicator member 25 is rotatably connected to its respective selector shaft 24 in the manner illustrated for example in U.S. Pat. No. 3,948,172. Each selector 20 is guidingly received in an opening 27 in the side plate 12.

Figure 2:
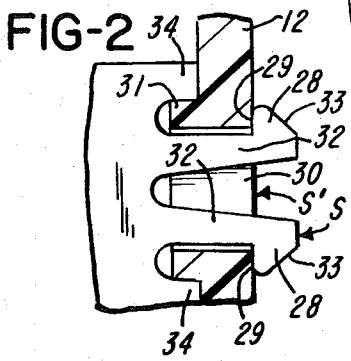
FIG. 2 is a partly sectional view showing a strong snap-fit connector of a type as used for a guide member and for one end of the mounting block shown in FIG. 1.
Figure 3:
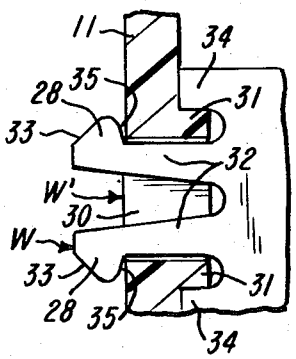
FIG. 3 is a partly sectional view showing a weak snap-fit connector of a type as used for the other end of a guide member and for the other end of the mounting block shown in FIG. 1.

The one sides of the mounting blocks 13 and 14 are shown to have strong snap-fit connector portions or fasteners S and there are cooperating connector portions S' in the side plate 11. The other sides of the mounting blocks 13 and 14 are shown to have weak snap-fit connector portions or fasteners W and there are cooperating connector portions W' in the side plate 12. Once mounting blocks 13 and 14 are snap-fitted to the side plate 11 they can be removed but only with relative difficulty. The snap-fit connectors S are snapped as shown in FIG. 2 with teeth 28 that abut squarely against shoulders 29 of connector portion S'. The connector portion S' is shown to comprise an elongated hole 30 framed by a rectangular flange or ridge 31. Each strong snap-fit connector portion S serves also to locate the respective block 14 accurately relative to the side plate 11. The connector portion S is shown to have a pair of flexible resilient spring fingers 32 having cam faces 33 to facilitate insertion into the respective hole 30. Guide members 38 illustrated in FIG. 2 also includes spaced pairs of projections 34 which straddle a respective flange 31. As shown, in flange 31 "plugs into" the connector portion S. The connector portion W is the same as the connector portion S except that cam faces 35 instead of square shoulders are provided to facilitate removal of the connector portion W from the connector portion W'. The connector portions W' are identical to the connector portion S', so therefore the same reference characters are used.

As shown, the other sides of the mounting blocks 13 and 14 have weak connector portion W which cooperate with connector portions W'. "Strong" and "weak" as used in this context means that when the side plates 11 and 12 and the mounting blocks 13 and 14 are connected, an attempt to separate the side plates 11 and 12 by pulling the side plates 11 and 12 apart will result in the side plate 12 being removed from the mounting blocks 13 and 14 and the side plate 11 remaining connected to the mounting blocks 13 and 14. Connector members 36 connect the side plates 11 and 12 together. Connector members 36 also hold the side plates in assembled generally parallel relationship. In that the connector members 36 also perform a guiding function they are also aptly termed guide members 37 and 38. The guide members 37 guide the indicator members 25. Each indicator member has flanges 39 received in opposed grooves 40 in a pair of the guide members 37. Thus, the guide members 37 are guided for axial sliding movement, while the respective selector 20 can rotate as well as slide axially. The guide members 37 and 38 each have a strong snap-fit connector portion S and a weak or easy-release snap-fit connector portion W. The guide members 37 have their strong connector portions S connected to cooperating connector portions S' on the side plate 12 and have their weak connector portions W connected to the cooperating connector portions W' on the side plate 11. Thus, an attempt to separate the side plates 11 and 12 by pulling the side plate 11 and 12 apart will result in the guide members 37 and 38 being removed from the side plate 11 but remaining connected to the side plate 12. Thus, the indicator members 20 remain supported by the guide members 37. The guide members 38 serve to guide an ink roller generally indicated at 39. The ink roller 39 has a pair of spaced bearing rolls or flanges 40 which bear against the respective guide members 38. The ink roller is rotatable about stub shafts 41 only one of which is shown. The bearing rolls 43 limit the amount of contact pressure which ink-receptive material 42 exerts against the printing members 22' at the printing zone Z.

The print head 10, except perhaps for the printing bands 22 and the ink-receptive material 42, is comprised of molded plastics material.

The strong connector portions S are shown on the mounting blocks 13 and 14 and on the connector members 36 and the corresponding connector portions S' are on the side plates 11 and 12. In an alternative construction (not shown) the strong connector portions S on the left sides of the mounting blocks 13 and 14, as viewed in FIG. 1, can be formed on the side plate 11 and the cooperating connector portions S' can be formed on the mounting blocks 13 and 14. In addition, the weak connector portions W on the left sides of the connectors 36 can be formed on the side plate 11 and the cooperating connector portions W' can be formed on the connectors 36. The right ends or sides of the mounting blocks 13 and 14 and the connectors 36, as viewed in FIG. 1, can remain the same as shown. By this alternative construction, it is impossible to assemble the print head incorrectly.

Other embodiments and modifications of this invention will suggest themselves to those skilled in the art and all such of these as come within the spirit of this invention are included within its scope as best defined by the appended claims.

I claim:

1. A print head having a pair of spaced first and second side plates, a mounting block, drive wheels rotatably mounted by the mounting block, the drive wheels having central holes defining a continuous axial opening, printing bands coupled to the drive wheels, the second side plate having means defining an opening, a selector extending through the opening in the second side plate and received in the continuous opening, means on the selector for engaging any selected wheel to advance any selected printing band, guide means connecting the first and second side plates, an indicator member coupled to the selector and slidably mounted by the guide members for indicating the printing band with which the selector is coupled, the selector being rotatable relative to the indicator member, the indicator member being shiftable in the axial direction as a unit with the selector, means for locating the guide members with respect to the first side plate, wherein the locating means includes releasable snap-connectors, snap-fit means for connecting the guide members to the second side plate sufficiently strongly so that if the second side plate is removed the guide members remain connected to the second side plate, means for locating the mounting block to the second side plate, and snap-fit means for connecting the mounting blocks to the first side plate sufficiently strongly so that if the second side plate is removed the mounting blocks remain connected to the first side plate.

2. A print head as defined in claim 1, means adapted to guide an ink roller including ink-roller guide members, means for locating the ink-roller guide members with respect to the first side plate, and snap-fit means for connecting the ink-roller guide members to the second side plate sufficiently strongly so that if the second side plate is removed the ink-roller guide members remain connected to the second side plate.

3. A print head as defined in claim 1, wherein the mounting block includes a concave mounting surface for rotatably mounting the drive wheels.

4. A print head having a pair of spaced first and second side plates, a plurality of mounting blocks, a series of drive wheels rotatably mounted by the mounting blocks, each series of the drive wheels having a central hole defining a continuous axial opening, printing bands coupled to each series of the drive wheels, the second side plate having means defining openings, a selector extending through each opening in the second side plate and received in the respective continuous opening, means on each selector for engaging any selected wheel to advance any selected printing band, guide means connecting the first and second side plates, an indicator member coupled to the respective selector and slidably mounted by the guide members for indicating the printing band with which the respective selector is coupled, each selector being rotatable relative to the indicator member, each indicator member being shiftable in the axial direction as a unit with the respective selector, means for locating the guide members with respect to the first side plate, wherein the locating means includes releasable snap-connectors, snap-fit means for connecting the guide members to the second side plate sufficiently strongly so that if the second side plate is removed the guide members remain connected to the second side plate, means for locating the mounting block to the second side plate, and snap-fit means for connecting the mounting blocks to the first side plate sufficiently strongly so that if the second side plate is removed the mounting blocks remain connected to the first side plate.

5. A print head as defined in claim 4, means adapted to guide an ink roller including ink-roller guide members, means for locating the ink-roller guide members with respect to the first side plate, and snap-fit means for connecting the ink-roller guide members to the second side plate sufficiently strongly so that if the second side plate is removed the ink-roller guide members remain connected to the second side plate.

6. A print head as defined in claim 2, wherein each mounting block includes a concave surface for rotatably mounting a series of the drive wheels.

7. Method of making a print head comprising the steps of: providing a pair of first and second side plates, providing a series of printing bands, providing a series of drive wheels, providing a selector for engaging any selected drive wheel, providing a mounting block for rotatably supporting the drive wheels, providing separate connector members for connecting the side plates to each other, connecting the mounting block strongly to the first side plate using snap fasteners and weakly to the second side plate using snap fasteners, connecting the connecting members strongly to the second side plate using snap fasteners and weakly to the first side plate using snap fasteners, the mounting block, drive wheels and printing bands being positioned between the first and second side plates with the selector extending through an opening in the second side plate and into engagement with any selected drive wheel, and wherein the snap fasteners that connect weakly release more easily than the snap fasteners that connect strongly.

8. Method of making a print head comprising the steps of: providing a pair of first and second side plates, providing a plurality of series of printing bands, providing a plurality of series of drive wheels, providing for each series of drive wheels a selector for engaging any selected drive wheel, a mounting block for rotatably supporting the drive wheels of each series, providing separate connector members for connecting the side plates to each other, connecting the mounting blocks strongly to the first side plate using snap fasteners and weakly to the second side plate using snap fasteners, connecting the connecting members strongly to the second side plate using snap fasteners and weakly to the first side plate using snap fasteners, the mounting blocks, drive wheels and printing bands being positioned between the first and second side plates with the selectors extending through openings in the second side plate and into engagement with any selected drive wheel, and wherein the snap fasteners that connect weakly release more easily than the snap fasteners that connect strongly.

9. Method of making a print head comprising the steps of: providing a pair of first and second side plates, providing a plurality of series of printing bands, providing a plurality of series of drive wheels, providing for each series of drive wheels a selector for engaging any selected drive wheel, providing a plurality of mounting blocks for rotatably supporting the drive wheels of each series, providing for each selector an indicator member for indicating the printing band with which the respective selector is coupled, providing guide members for the indicator members, providing guide members for an ink roller used to ink the printing members, providing each guide member with a strong snap-fit connector portion at one end and a releasable snap-fit locator portion at its other end, providing each mounting block with a strong snap-fit connector portion at its one end and a releasable snap-fit locator portion at its other end, providing the first side plate with connector portions for the mounting blocks and releasable snap-fit locator portions cooperable with the guide member locator portions, providing the second side plate with releasable snap-fit locator portions for the mounting block locator portions and snap-fit connector portions for the guide member connector portions, connecting the mounting blocks to the first side plate using the cooperating strong snap-fit connector portions, connecting the guide members to the second side plate using the cooperating strong snap-fit connector portions, locating the second side plate relative to the first side plate, the mounting blocks, the drive wheels and the printing bands using the cooperating locator portions, and wherein the strong snap-fit connector portions hold more strongly than the locator portions.

10. Method of making a print head comprising the steps of: providing a pair of first and second side plates, providing a plurality of series of printing bands, providing a plurality of series of drive wheels, providing for each series of drive wheels a selector for engaging any selected drive wheel, providing a plurality of mounting blocks for rotatably supporting the drive wheels of each series, providing for each selector an indicator member for indicating the printing band with which the respective selector is coupled, providing separate guide members for the indicator member, providing each guide member with a strong snap-fit connector portion at one end and a releasable snap-fit locator portion at its other end, providing each mounting block with a strong snap-fit connector portion at its one end and a releasable snap-fit portion at its other end, providing the first side plate with snap-fit connector portions for the mounting blocks and locator portions cooperable with the guide member locator portions, providing the second side plate with releasable snap-fit locator portions for the mounting block locator portions and snap-fit connector portions for the guide member connector portions, connecting the mounting blocks to the first side plate using the cooperating strong snap-fit connector portions, connecting the guide members to the second side plate using the cooperating strong snap-fit connector portions, locating the second side plate relative to the first side plate, the mounting blocks, the drive wheels and the printing bands using the cooperating locator portions, and wherein the strong snap-fit connector portions hold more strongly than the locator portions.

* * * * *

UNITED STATES PATENT AND TRADEMARK OFFICE

CERTIFICATE OF CORRECTION

PATENT NO. : 4,524,686

DATED : June 25, 1985

INVENTOR(S) : Donald L. Karn

It is certified that error appears in the above-identified patent and that said Letters Patent are hereby corrected as shown below:

Column 3, line 50, after "roller" --R-- has been omitted.

Column 5, line 22, "2" should be --4--.

Signed and Sealed this

*Fifteenth* Day of *October 1985*

[SEAL]

*Attest:*

DONALD J. QUIGG

*Attesting Officer*

*Commissioner of Patents and Trademarks—Designate*